United States Patent [19]

Reist

[11] Patent Number: 4,769,973

[45] Date of Patent: Sep. 13, 1988

[54] METHOD AND APPARATUS FOR PROCESSING PRINTED PRODUCTS, SUCH AS NEWSPAPERS, MAGAZINES AND THE LIKE, ARRIVING IN AN IMBRICATED FORMATION AND WOUND PACKAGES PRODUCED THEREBY

[75] Inventor: Walter Reist, Hinwil, Switzerland

[73] Assignee: Ferag AG, Hinwil, Switzerland

[21] Appl. No.: 3,607

[22] Filed: Jan. 15, 1987

[30] Foreign Application Priority Data

Jan. 20, 1986 [CH] Switzerland ..... 205/86

[51] Int. Cl.[4] ..... B65H 5/28

[52] U.S. Cl. ..... 53/430; 53/118; 242/59; 414/38

[58] Field of Search ..... 53/430, 118, 117, 116; 414/38; 242/59, 79

[56] References Cited

U.S. PATENT DOCUMENTS

| | | | |
|---|---|---|---|
| 3,604,648 | 9/1971 | Schmidt | 242/56 R |
| 3,700,185 | 10/1972 | Hubbard et al. | 242/159 |
| 3,763,619 | 10/1973 | Stone | 53/430 X |
| 4,366,661 | 1/1983 | McGraner | 53/430 X |
| 4,525,982 | 7/1985 | Meier | 53/430 |
| 4,610,592 | 9/1986 | Pienta | 414/38 |
| 4,625,957 | 12/1986 | Du Fresne | 414/38 X |
| 4,630,986 | 12/1986 | Taylor | 414/38 X |
| 4,637,198 | 1/1987 | Gerber | 53/430 |

FOREIGN PATENT DOCUMENTS

| | | | |
|---|---|---|---|
| 2207556 | 8/1973 | Fed. Rep. of Germany . | |
| 3319964 | 12/1983 | Fed. Rep. of Germany . | |
| 559691 | 1/1975 | Switzerland . | |
| 2121771 | 1/1984 | United Kingdom | 53/430 |

*Primary Examiner*—James F. Coan

*Attorney, Agent, or Firm*—Werner W. Kleeman

[57] ABSTRACT

The printed products arriving in an imbricated formation are wound up into wound product packages or coils each having a substantially horizontally disposed longitudinal axis. These wound products packages possess a predetermined size and an inherent stability which permit them to be transported and intermediately stored such that their longitudinal axes extend substantially vertically without the wound product packages disintegrating or unraveling. After forming the wound product packages they are transferred from a standing position into a reclining or reposing position by means of a package turning device. In this reclining or reposing position the longitudinal axes of the wound product packages extend substantially vertically. These wound product packages are supported only at their circumference or are only held at their winding cores and are not supported in any further manner.

41 Claims, 4 Drawing Sheets

METHOD AND APPARATUS FOR PROCESSING PRINTED PRODUCTS, SUCH AS NEWSPAPERS, MAGAZINES AND THE LIKE, ARRIVING IN AN IMBRICATED FORMATION AND WOUND PACKAGES PRODUCED THEREBY

CROSS REFERENCE TO RELATED APPLICATION

This application is related to the commonly assigned, copending U.S. application Ser. No. 07/005,698, filed Jan. 22, 1987, entitled "Method of and Apparatus for, Interim Storing of Printed Products, typically Newspapers, Periodicals and the like, Arriving in an Imbricated Product Formation", and listing as the inventor Werner Honegger.

BACKGROUND OF THE INVENTION

The present invention broadly relates to a new and improved method and apparatus for processing printed products or articles, such as newspapers, magazines, periodicals and the like, arriving in an imbricated formation and to a wound product package or coil which is produced according to this method.

Generally speaking, the method of the present invention comprises the steps of delivering the imbricated product formation at a winding station to at least one hollow drivable substantially cylindrical winding core having a substantially horizontally disposed longitudinal or lengthwise axis and associated with the winding station. At the winding station there is then formed at least one complete wound product package by rotating the at least one hollow drivable substantially cylindrical winding core about its longitudinal axis in order to wind up the imbricated formation onto the at least one hollow substantially cylindrical winding core. The winding up of the imbricated formation is undertaken such that a preselected one of the substantially flat sides of the imbricated formation face the at least one hollow drivable substantially cylindrical winding core and in conjunction with at least one winding strap which is maintained under tension during the winding operation. Then there is transported away the at least one completed or finished wound product package from the winding station.

The product processing apparatus of the present invention comprises a winding station provided with at least one hollow drivable substantially cylindrical winding core possessing a substantially horizontally disposed longitudinal or lengthwise axis and operatively associated with the winding station. The at least one hollow drivable substantially cylindrical winding core is rotatably driven to rotate about its substantially horizontally disposed longitudinal or lengthwise axis. Conveying means are provided for conveying or infeeding the imbricated formation with one of the substantially flat sides of the printed products facing the at least one hollow substantially cylindrical winding core. At least one winding strap is connected to the at least one hollow substantially cylindrical winding core and is wound under a predeterminate tension conjointly with the imbricated formation onto the at least one hollow drivable substantially cylindrical winding core for forming at least one complete or finished wound product package or coil. Transporting means are also provided for transporting the at least one complete wound product package or coil away from the winding station.

The wound product package or coil of the present invention comprises a hollow substantially cylindrical winding core, a tensioned winding strap, a plurality of printed products wound in layers or turns upon the hollow substantially cylindrical winding core conjointly with the tensioned winding strap such that the tensioned winding strap is located between the wound layers or turns.

With the present conventional high operating speeds of rotary printing presses and the processing apparatuses which are arranged subsequent thereto, it was previously endeavored to wind up as many printed products or articles as possible onto a winding core in order not to be forced to frequently exchange a complete wound product package or coil with an empty winding core or, as the case may be, to exchange an empty winding core for a new wound product package or coil. Such prior art apparatuses are described, for example, in the Swiss Pat. No. 559,691, published Mar. 14, 1975 and the Swiss Pat. No. 642,602, published Apr. 30, 1984 and its cognate U.S. Pat. No. 4,438,618. In the prior art it is presently conventional to form wound product packages with a diameter greater than 2 meters. Such wound product packages or coils are naturally correspondingly heavy and are not easily manipulated or handled or easily intermediately stored.

In the aforementioned Swiss Patent No. 559,691, for example, the hollow cylindrical winding core is provided with discoidal side plates which are designed as rolling support side plates for transporting the wound product package. These side plates further serve to laterally support the printed products which are wound up. Substantial space or volume in elevation or height, depth and also in the direction of the longitudinal axis of the winding core is necessary for storing such wound product packages because of the presence of these side plates since the dimension of the wound product package and its wind-up structure in the axial direction of the winding core thereof is larger than the width of the wound-up printed articles or printed products.

The International Published Patent Application No. 85/01,279 (Swiss PCT Convention Application No. 00,147) and the cognate U.S. Pat. No. 4,601,436, granted Jul. 22, 1986, further makes known specially constructed transport vehicles for transporting large and heavy wound product packages or coils and using winding cores which are adapted to fit these transport vehicles. These transport vehicles are further equipped to stack the wound product packages on top of one another into a standing or upright stack which is slightly inclined or sloping with respect to the vertical. The wound product packages or coils are supported at their circumference or periphery at the floor. Such a stack likewise requires a great deal of space or area and further necessitates the availability of a vertical support, for example a wall, against which there can be leaned the rearmost wound product package of the stack of wound product packages.

SUMMARY OF THE INVENTION

Therefore, with the foregoing in mind, it is a primary object of the present invention to provide a new and improved method and apparatus for processing printed products or articles, such as newspapers, magazines, periodicals and the like, arriving in an imbricated formation in order to form wound product packages or coils in a manner which does not exhibit the aforementioned drawbacks and shortcomings of the prior art.

Still a further significant object of the present invention is to provide a new and improved method and apparatus for winding up printed products or the like upon a winding core in order to form wound product packages or coils which can be reliably and protectively processed or handled in a relatively simple manner.

Another and more specific object of the present invention aims at providing a new and improved wound product package or coil which can be handled and stored with less expenditure of work than previously was the case while still maintaining careful handling of the wound up printed articles or products.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the steps of forming at least one complete wound product package from the printed products or articles which is capable of resisting disintegration or unraveling during handling in an orientation in which the longitudinal axis of the at least one complete or finished wound product package extends substantially vertically, and that the at least one complete or finished wound product package is placed into an orientation or position in which the longitudinal axis thereof extends substantially vertically for performing a desired one of the steps of transporting or intermediately storing the at least one complete or finished wound product package, or both.

The product processing apparatus of the present invention is manifested by the features that means are provided for placing the at least one complete or finished wound product package into an orientation or position in which the longitudinal axis of such at least one complete or finished wound product package extends substantially vertically.

The wound product package or coil of the present invention is manifested by the features that the at least one wound product package or coil has a predetermined volume or size and an inherent stability permitting safe and protective handling of the at least one wound product package for performing a desired one of the steps or operations of transporting or intermediately storing the at least one wound product package or coil while the longitudinal axis of the at least one wound product package or coil extends substantially vertically without disintegration or unraveling of the at least one wound product package occurring, or a combination of transporting and intermediately storing the at least one wound product package while the longitudinal axis of the at least one wound product package extends substantially vertically without disintegration or unraveling of the at least one wound product package occurring.

Contrary to the former practice of forming large wound product packages or coils, the present invention contemplates the formation of individual smaller wound product packages or coils which make an easy or simple handling as well as a space-saving storage of the wound product packages possible. Individual articles or products like printed articles or printed products which were previously wound up into a single wound product package or coil are now divided or distributed into a plurality of wound product packages or coils.

It is possible to transport and store these smaller wound product packages or coils in a reclining or reposing position or orientation, that is to say with their longitudinal axis extending substantially vertically, since the smaller wound product packages or coils are self-supporting and are capable of resisting disintegration or unraveling when they are placed into an orientation in which their longitudinal axis extends substantially vertically, even when the printed products are not supported at the underside of the wound product packages or coils.

This can be accomplished even though the wound up imbricated formation is inherently not self-supporting since it is comprised of individual products or articles which are not connected with one another and which are easily separable or detachable from one another. This is contrary to a wound product package or coil formed from a continuous paper web or synthetic material web in which the individual winding layers or turns lie completely upon one another, thus providing a sufficiently large frictional force between these winding layers or turns to prevent a disintegration of the wound product package or coil.

Previously there was avoided handling wound product packages or coils comprising wound-up individual products like printed products, wherein such wound product packages or coils had longitudinal axes extending substantially vertically. The handling and storage of such wound product packages or coils were accomplished with wound product packages or coils having longitudinal axes extending substantially horizontally. Additionally, winding cores were utilized having support discs or plates extending laterally of the wound-up printed products or articles.

The storage area or space required for these new smaller wound product packages processed according to the present invention can be reduced compared with known wound product packages due to the smaller dimensions of the new wound product packages and also of their winding cores since the new smaller or smaller size wound product packages can be superimposed or stacked upon one another into a stack or tower with their longitudinal axes extending substantially vertically. It is not necessary to insert an intermediate layer or separator between these new wound product packages or coils. On the contrary, the new smaller size wound product packages or coils can be superimposed or stacked directly upon one another. Since the new smaller size wound product packages or coils are supported at their flat sides and not at their circumferences or peripheries, it is possible to stack the new smaller size wound product packages into stable towers or tower-like formations or stacks of considerable height.

The new smaller or smaller size wound product packages or coils are preferably placed onto pallets. These pallets permit transporting the smaller wound product packages or coils by means of conventional transportation or transport means, for example with fork lift trucks, lift trucks, roller tracks or roll conveyors and so forth. A plurality of new smaller or smaller size wound product packages or coils thus can be transported together in this manner without difficulty, upon which at least the same amount of printed products or articles are wound as with a large wound product package or coil of conventional type. With reference to the amount of printed products or articles transported, no disadvantage in relation to the heretofore known solutions results from the division of a predetermined number of printed products into a plurality of smaller or smaller size wound product packages or coils.

The wound-up printed products or articles are stored with their edges upright when the new smaller or smaller size wound product packages or coils are stored with their longitudinal axes extending substantially vertically, that is to say, the printed products or the like are not in the same orientation as when they were delivered to the new wound product package being formed. This results in the already mentioned advantages of reduced intermediate storage space and a problem-free handling of the new smaller wound product packages or coils. The new wound product packages or coils or the winding cores, as the case may be, are brought into an orientation or position in which their longitudinal axes extend substantially horizontally for coiling or winding up the imbricated formation onto the winding cores and for uncoiling or unwinding the imbricated formation or wound products from the winding cores. This permits a respective delivery or removal of the imbricated product formation in its original orientation which thus makes possible a simple conveyance and further processing of the imbricated product formation.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof only enough of the structure of the apparatus for processing individual products like printed products or articles, such as newspapers, magazines, periodicals and the like, having a predetermined number of substantially flat sides and arriving in an imbricated product formation has been illustrated therein as is needed to enable one skilled in the art to readily understand the underlying principles and concepts of this invention.

Figure 1:
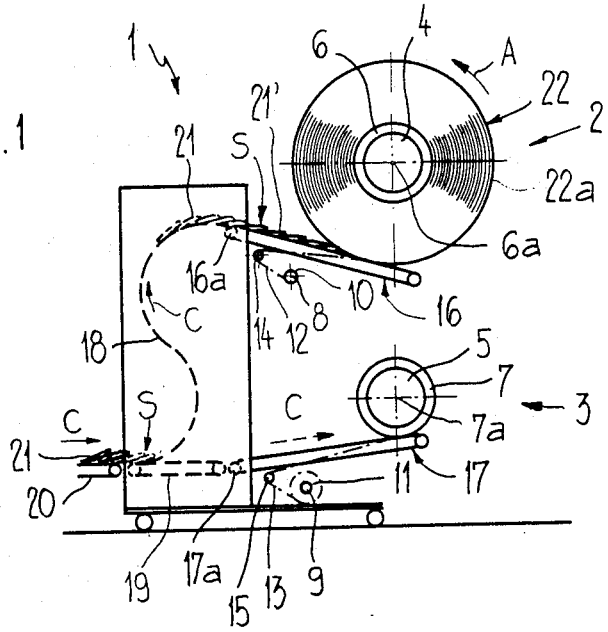
FIG. 1 schematically illustrates side view of a winding or wind-up station.

Turning now specifically to FIG. 1 of the drawings, the apparatus illustrated therein by way of example and not limitation will be seen to comprise a transportable or mobile coiling or winding station 1. This mobile winding station 1 comprises, for instance, two superimposed winding positions or locations, namely an upper winding position or location 2 and a lower winding position or location 3. Each winding position or location 2 and 3 is provided with a bearing support or journals 4 and 5, respectively, which is only schematically illustrated in FIG. 1, for mounting respective hollow drivable substantially cylindrical winding drums or cores 6 and 7. These bearing supports or journals 4 and 5 are designed such that the winding cores 6 and 7 are rotatably mounted for rotation about substantially horizontally disposed longitudinal or lengthwise axes 6*a* and 7*a*, respectively. Each hollow substantially cylindrical winding core has an inner side or wall forming a substantially cylindrical jacket surface over its entire length.

Furthermore, each winding position or location 2 and 3 is operatively associated with a further bearing support or journal 8 and 9, respectively, which is likewise only schematically illustrated and which is operatively associated with respective supply reels or spools 10 and 11 for respective winding straps or bands 12 and 13 or the like. These winding straps 12 and 13 travel over respective drive rolls or rollers 14 and 15. A respective belt or band conveyor or delivery means 16 and 17, designed as a rocker or pivoting conveyor, is positioned below the associated bearing support or journal 4 and 5 for the related winding core 6 and 7.

Each of these belt or band conveyors 16 and 17 is pivotably mounted at one end about a respective shaft or axis 16*a* and 17*a*. Each belt or band conveyor 16 and 17 is connected in series with or located downstream of a respective further conveyor 18 and 19. The conveyor 18 is not particularly further illustrated here. Connected in series with or located upstream of the conveyors 18 and 19 is a common delivery or transport conveyor 20 provided for delivering superimposed or overlapping imbricated printed products or articles 21.

An imbricated formation or imbricated product formation S of individual products like printed products 21 delivered by the transport conveyor 20 is selectively delivered or infed to one of the two conveyors 18 or 19 by means of a suitable or known switch or transfer means which is thus not illustrated in FIG. 1. FIG. 1 illustrates the case in which the incoming imbricated formation S is delivered to the upper winding or coiling position or location 2 in the direction of the arrow C by means of the conveyors 18 and 16.

At the upper winding or coiling position or location 2 the imbricated formation S is wound or coiled up with a flat side 21' of the individual products like the printed products 21 facing the winding core 6, the product winding operation being accomplished together with the winding strap 12 which is held under a predeterminate tension. The winding core 6 is appropriately driven in the direction of the arrow A by a not particularly illustrated but conventional drive means. The winding or coiling of the imbricated formation S onto the winding core 6 is basically accomplished in the manner described in the aforementioned Swiss Pat. No. 642,602 which is cognate with the likewise aforementioned U.S. Pat. No. 4,438,618.

A self-supporting wound product package or coil 22 of the individual products like the printed products 21 is formed on the winding core 6. The dimensions or size of this wound product package or coil 22 of individual products or printed products 21 are such that the complete or finished wound product package 22 resists disintegration or unraveling if the complete wound product package 22 is brought into an orientation or position in which the longitudinal or lengthwise axis 6*a* of the complete or finished wound product package 22 extends substantially vertically.

Figure 2:
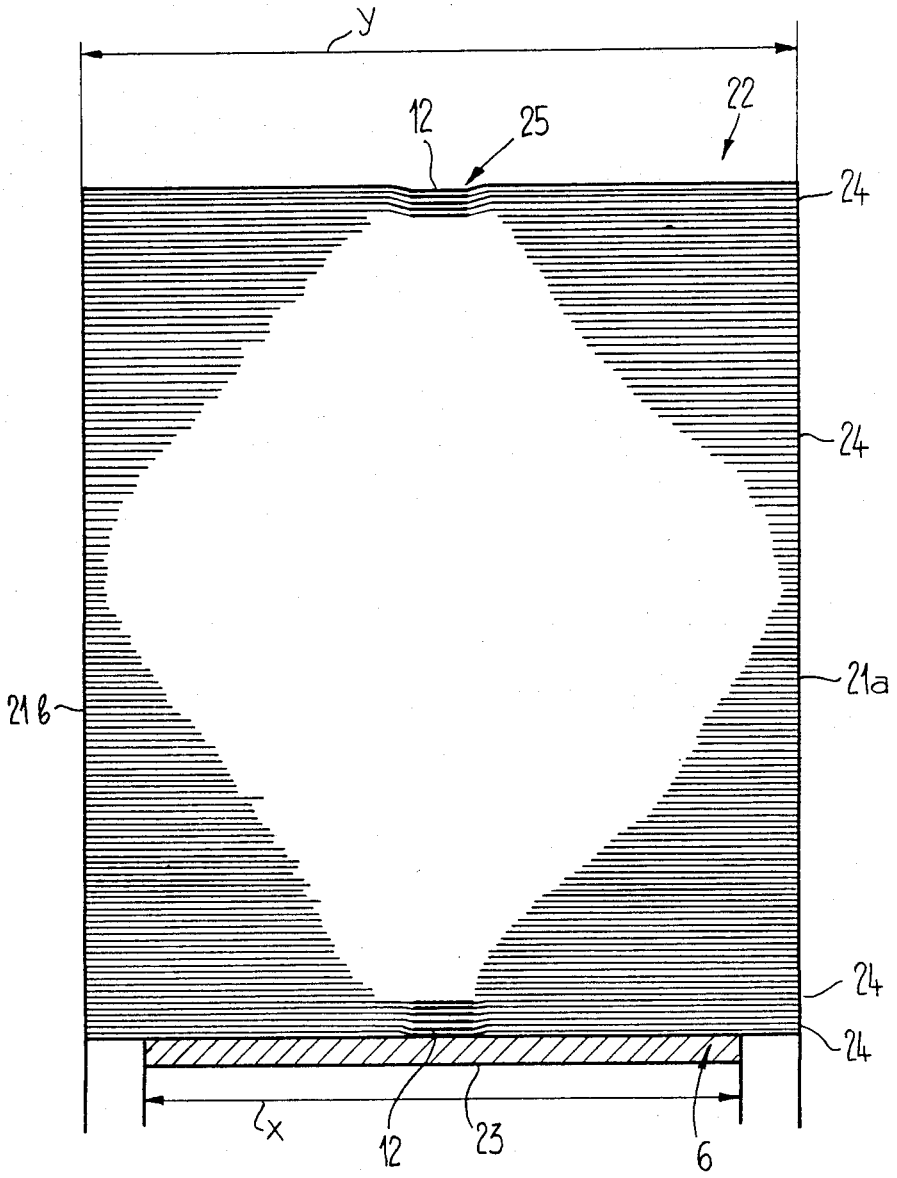
FIG. 2 schematically illustrates in section a part or portion of a wound product package or coil.

FIG. 2 illustrates in an enlarged scale and in section a portion of such a complete or finished wound product package or coil 22. As can be seen in FIG. 2, the length X of the winding core 6 is less than the width Y of the wound or coiled up printed products 21. The coiled or wound-up printed products 21 thus laterally extend past the outer edges of the winding core 6. Side edges 21*a* and 21*b* of the printed products 21 lie completely free or exposed. The finished wound product package or coil 22 is thus not supported in the region of these side edges 21*a* and 21*b*.

FIG. 2 further shows the winding strap or band 12 or the like which is wound between individual winding layers or turns 24 of the wound product package or coil 22. The wound product package or coil 22 comprises a constriction or area of contraction or compression 25 in the region of the winding strap 12. That is to say, the printed products 21 are somewhat deformed or compressed in the region of the winding strap 12. This deformation contributes to the fact that the finished wound product package 22 is self-supporting in that a mutual movement of the printed products 21 in the direction of the longitudinal axis 6*a* of the finished wound product package 22 is made more difficult by the engagement or interlocking of the printed products 21 in the region of the constriction or area of contraction 25 if the finished wound product package 22 is transported or stored with its longitudinal axis 6*a* extending substantially vertically.

As soon as the wound product package 22 reaches its final or predeterminate size at the upper winding position or location 2, i.e. as soon as the complete or finished wound product package is completely wound, the incoming imbricated formation S is redirected onto the lower winding position or location 3 and wound or coiled up on the related winding core 7 in the manner which has been previously described. During this time the finished wound product package 22 can be removed from the upper winding position or location 2 and can be replaced by a new, empty winding core 6.

FIGS. 3, 4, 5 and 6 illustrate devices or facilities which are suitable for handling the finished wound product packages or coils 22.

Figure 3:
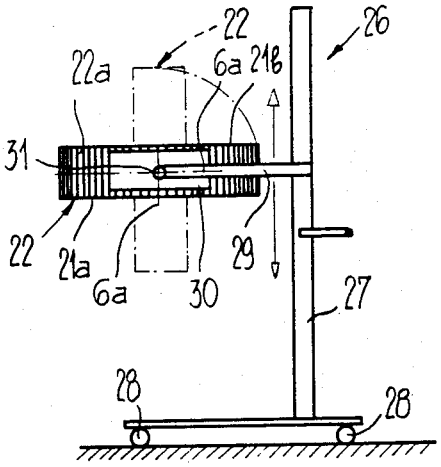
FIG. 3 schematically illustrates in side view a first embodiment of a turning device for the wound product packages or coils.
Figure 4:
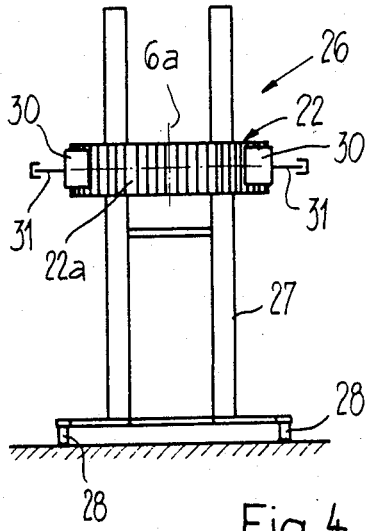
FIG. 4 schematically illustrates in front view the turning device shown in FIG. 3.

A package or coil turning device 26 illustrated in FIGS. 3 and 4 comprises a frame or stand 27 which is supported or mounted on wheels 28. Two elevatable substantially horizontal load-bearing or carrier arms 29 are positioned on this frame or stand 27. Each of these load-bearing or carrier arms 29 is provided with a gripping or clamping jaw 30 at its free end portion which is furthest away from the frame or stand 27. Each gripping jaw 30 is pivotably or rotatably mounted about an axis or shaft 31 at the associated load-bearing or carrier arm 29. The finished wound product packages 22 are gripped and held at their periphery or circumference 22*a* by means of the gripping jaws 30. The mutual spacing or distance of the gripping jaws 30 from one another can be appropriately varied or changed.

For removing the finished wound product package 22 illustrated in a chain-dotted line in FIG. 3 from the respective upper or lower winding position or location 2 and 3, this finished wound product package 22 is clamped between the two pivotable clamping jaws 30 which have been rotated into their essentially vertical position and is removed from the associated bearing support or journal 4 and 5. The finished wound product package 22 is subsequently brought into an orientation for further handling, that is to say for transporting and for intermediately storing, by turning or rotating the gripping jaws 30 about the shaft or axis 31 through an angle of substantially 90° such that the longitudinal or lengthwise axis 6*a* of the finished wound product package 22 extends substantially vertically as illustrated in FIGS. 3 and 4.

Figure 5:
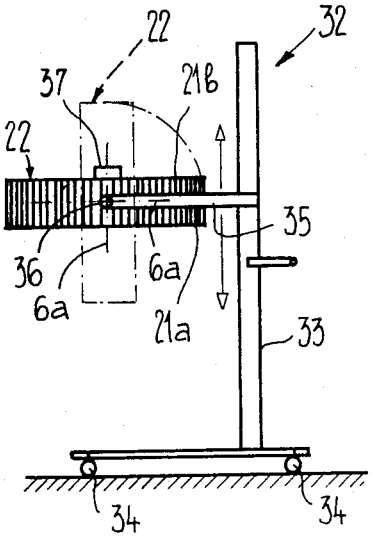
FIG. 5 schematically illustrates in side view a second embodiment of a turning device for the wound product packages or coils.
Figure 6:
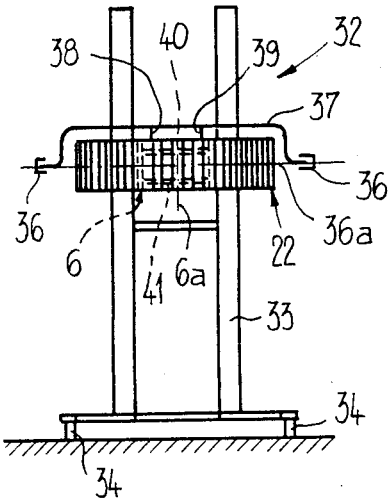
FIG. 6 schematically illustrates in front view the turning device shown in FIG. 5.

A further embodiment of package or coil turning device 32 illustrated in FIGS. 5 and 6 likewise comprises a frame or stand 33 which is provided with wheels 34. Two elevatable load-bearing or carrier arms 35 extend from the frame or stand 33. These load-bearing or carrier arms 35 are provided with pivot joints 36 at their free end regions which are furthest from the frame or stand 33. A holder or carrier member 37 is pivotably or rotatably mounted about a horizontal axis 36*a* in these pivot joints 36. Two clamps or grippers 38 and 39 protrude from this holder or carrier member 37. The mutual distance or spacing of these clamps or grippers 38 and 39 from one another is likewise appropriately variable. These clamps or grippers 38 and 39 engage at a circumferential or continuous rib or rib means 40 which is attached to the inner side of the winding core 6 and thus hold the winding core 6. The winding core 6 is provided with a second circumferential or continuous rib or rib means 41 which serves to support the winding core 6 on the associated bearing support or journal 4 or 5, as the case may be.

The package turning device 32 engages or grips the finished wound product package 22 suspended from the associated bearing support or journal 4 or 5 by means of the clamps or grippers 38 and 39 and raises the finished wound product package 22 away from the associated bearing support or journal 4 or 5. Subsequently, the finished wound product package 22 illustrated in FIG. 5 in a chain-dotted line is placed into an orientation or position, by turning the holder or carrier member 37 about the axis 36*a*, such that the longitudinal axis 6*a* of the finished wound product package 22 assumes a substantially vertical direction or orientation. The finished wound product package or coil 22 is transported and stored in this orientation.

The package turning device 26 according to FIGS. 3 and 4 only holds the finished wound product package 22 at its circumference or periphery 22*a* and the package turning device 32 according to FIGS. 5 and 6 only holds the finished wound product package 22 at the winding core 6. There is no support of the printed products 21 at the underside or lower side, that is to say at the side of the side edges 21*a* of the finished wound product package 22. Since the finished or complete wound product package or coil 22 exhibits a predetermined volume or size and an inherent stability, as already mentioned, such that it is self-supporting, the finished wound product package 22 also does not disintegrate or unravel in the horizontal transporting position or orientation shown in FIGS. 3 through 6. This not only permits the finished wound product package 22 to be transported in this horizontal position but also to be stacked in this horizontal position or orientation.

Figure 7:
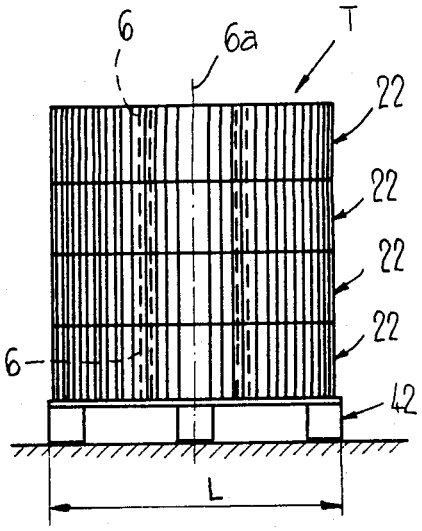
FIG. 7 schematically illustrates in side view a stack of wound product packages or coils resting on a pallet.
Figure 8:
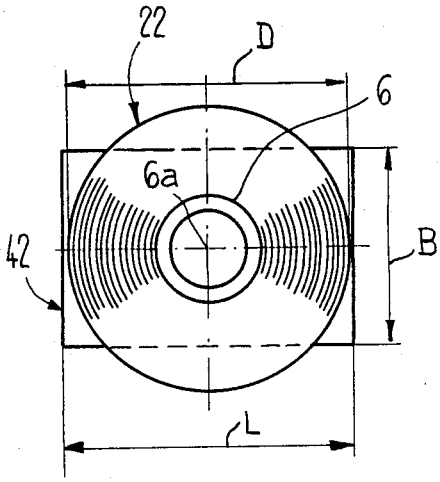
FIG. 8 schematically illustrates in top plan view the stack of wound product packages or coils resting on the pallet and as shown in FIG. 7.

A tower or stack T formed from a plurality of directly superimposed finished wound product packages or coils 22 is illustrated in FIGS. 7 and 8 and which lies on a pallet 42. The longitudinal or lengthwise axes 6a of all finished wound product packages 22 extend substantially vertically. The outer diameter D of the finished wound product packages 22 is somewhat smaller than the length L of the pallet 42 as is illustrated in FIG. 8. This allows the package tower or stack T to be moved together with the pallet 42 by means of conventional transport devices, for example a fork lift truck or a lift or elevatable truck. The pallets 42 can be loaded at the winding station 1 by means of the turning devices 26 and 32 and subsequently brought into an intermediate storage area or unloaded onto a vehicle. Conventional means, as already mentioned, can be utilized for this purpose. It is advantageous for this purpose if the outer diameter D of the finished wound product packages 22 is not or is only slightly greater than the length L or the width B of the pallets 42 utilized.

Figure 9:
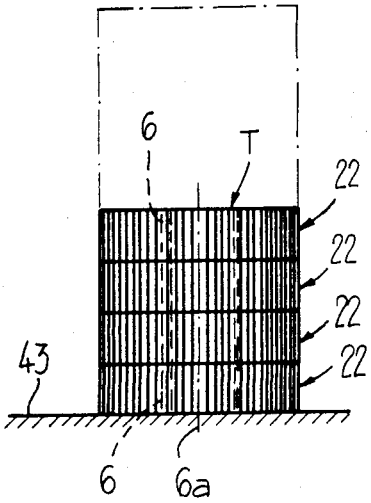
FIG. 9 schematically illustrates in side view a stack of wound product packages or coils resting on the floor.

Furthermore, it is of course possible to stack the plurality of finished wound product packages 22 into a tower or stack T which directly rests on a floor surface or floor 43 as is shown in FIG. 9. With this type of storage, the transport of the finished or complete wound product packages 22 from the winding station 1 to the storage location is accomplished by means of turning devices of the type illustrated in FIGS. 3 through 6. The turning devices, however, must not necessarily be equally capable or constructed in the same manner as the turning devices 26 and 32 to bring or transfer the finished wound product packages 22 from the vertical into the horizontal position or orientation as shown in FIGS. 3 through 6, since these transport devices only have to transport the finished wound product packages 22 which have already been previously brought into such horizontal orientation by the package turning device 26 or 32, as the case may be. It is also possible to design these transport devices such that they are capable of simultaneously transporting two and more finished wound product packages 22 for example, as forklift trucks or lift trucks.

Figure 10:
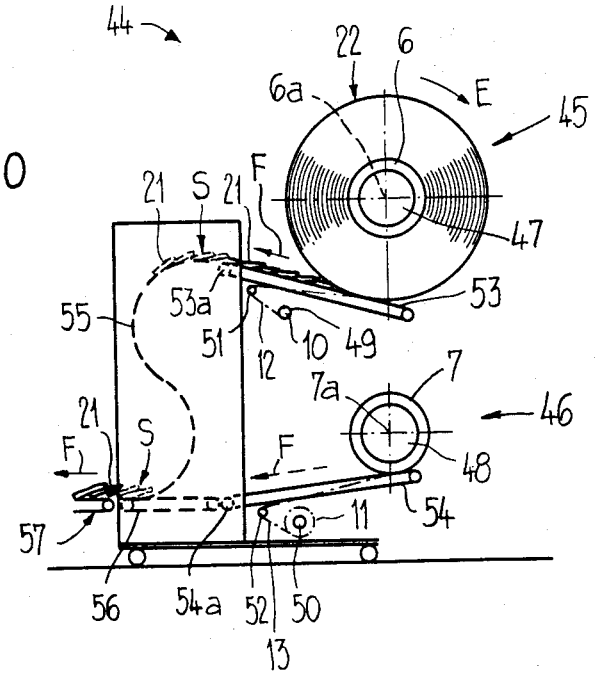
FIG. 10 schematically illustrates in side view an uncoiling or unwinding station.

If the printed products or articles 21 which have been wound up into finished wound product packages 22 are needed for further processing, these finished wound product packages 22 or the towers or stacks T of palletized wound product packages 22 are brought to an uncoiling or unwinding station 44 as is illustrated, for example, in FIG. 10. This unwinding or uncoiling station 44 is preferably located in the vicinity of the further processing apparatus.

The uncoiling or unwinding station 44 shown in FIG. 10 is very similar to the winding or coiling station 1 according to FIG. 1 and comprises two superimposed unwinding or uncoiling positions or locations 45 and 46. A respective bearing support or journal 47 and 48, which is only schematically illustrated, is provided for the respective winding cores 6 and 7 at the respective unwinding or uncoiling locations 45 and 46. Each unwinding location 45 and 46 is provided with a bearing support or journal 49 and 50, respectively, for journaling the related supply reels or spools 10 and 11 for the winding straps or bands 12 and 13, respectively. The winding straps or bands 12 and 13 or equivalent structure are guided over respective appropriately driven conveyor rolls or rollers 51 and 52.

Below each bearing support or journal 47 and 48 there is positioned a belt or band conveyor 53 and 54, respectively, which is designed as a rocker or pivotable conveyor which is pivotably mounted at one end about the associated shaft or axis 53a and 54a, respectively. Further conveyors 55 and 56, respectively, are located downstream of or subsequent to the band or belt conveyors 53 and 54, wherein the conveyor 55 is not here particularly further illustrated. Both conveyors 55 and 56 lead to a not particularly illustrated switch or transfer means at which there merges a transport or outfeed conveyor 57 for removal of the imbricated formation S and thus the printed products 21.

The wound product packages or coils 22, which are brought in a substantially horizontal reclining or reposing orientation to the unwinding or uncoiling station 44, are brought or transferred into the vertical position or standing orientation by means of the related turning devices 26 and 32, as shown in FIGS. 3 through 6, by bringing the longitudinal axis 6a of the finished wound product packages 22 into a substantially horizontal position. With the finished or complete wound product package or coil extending in this vertical or standing orientation, a respective finished wound product package 22 is placed on a given bearing support or journal 47 or 48, respectively. Subsequently the associated winding strap 12 or 13 is connected to the corresponding supply reel or spool 49 and 50, as the case may be. The winding strap 12 or 13 and thus the imbricated formation S is unwound from the related finished wound product package 22 by driving the associated conveyor roller 51 or 52, as the case may be. The wound product package 22 is thus rotated in the direction of the arrow E. The unwound imbricated formation S is transported or conveyed away from the uncoiling or unwinding station 44 in the direction of the arrow F. The unwinding of the imbricated formation S from the wound product package 22 is basically accomplished in the manner described in the aforementioned Swiss Pat. No. 642,602 and the cognate U.S. Pat. No. 4,438,618.

In FIG. 10 an empty winding core 7 is shown at the lower unwinding or uncoiling location or position 46 which can be removed and replaced by a new finished or complete wound product package or coil 22 while the previously prepared wound product package or coil 22 is unwound or uncoiled at the upper unwinding location or position 45.

The herein described embodiments of the respective coiling and uncoiling stations 1 and 44 utilized as double stations allow a continuous coiling or winding up of the arriving imbricated formation S, or allow an uncoiling or unwinding of the printed products 21 as a continuous imbricated formation S, even though it is necessary from time to time to exchange a full or complete wound product package or coil 22 for an empty winding core 6 or 7, or to replace an empty winding core 6 or 7 with a full or complete wound product package or coil 22. Both winding or coiling locations or positions 2 and 3, or the respective unwinding or uncoiling locations or positions 45 and 46 can be superimposed without an undue amount of space in the vertical direction being necessary since the full or complete or finished wound product packages 22 do not have a very large outer diameter (as a rule smaller than 2 meters).

It has been found that finished wound product packages can be formed having an outer diameter of approximately 150 cm on winding cores 6 and 7 having an outer diameter of 50 cm. These finished or complete wound product packages or coils 22 do not disintegrate or unravel during transportation or storage when their longitudinal or lengthwise axes 6a extend substantially vertically, even though such finished wound product packages 22 are not supported on their lower or underside.

It is to be understood that suitable package or coil turning or manipulating devices which are constructed differently than the package or coil turning or manipulating devices 26 and 32 illustrated in FIGS. 3 through 6 can also be utilized for bringing the finished wound product packages 22 from the vertical into the horizontal position or orientation and vice versa.

The aforedescribed coiling or winding up of the incoming imbricated formation S into self-supporting wound product packages 22 produce many advantages, several of which are: space-saving storing of the finished wound product packages, simple transport of the finished wound product packages with substantially conventional apparatuses or equipment, and no large investments necessary for special apparatuses and special installations.

While there are shown and described present preferred embodiments of the invention, it is to be distinctly understood that the invention is not limited thereto, but may be otherwise variously embodied and practiced within the scope of the following claims.

Accordingly, what I claim is:

1. A method of processing individual printed products, such as newspapers, magazines, periodicals and the like arriving in an imbricated formation and having a predetermined number of substantially flat sides, comprising the steps of:

delivering the imbricated formation to at least one hollow substantially cylindrical winding core having a substantially horizontally disposed longitudinal axis;

forming from said imbricated formation of individual printed products at least one wound package containing said individual printed products and having a longitudinal axis by rotating said at least one hollow substantially cylindrical winding core about said substantially horizontally disposed longitudinal axis of said winding core and winding up the imbricated formation on said at least one hollow substantially cylindrical winding core with a preselected one of said predetermined number of substantially flat sides of the imbricated formation of the individual printed products facing said at least one hollow substantially cylindrical winding core conjointly with at least one winding strap while maintaining said at least one winding strap under tension;

said at least one wound package of individual printed products being wound with a predeterminate number of the individual printed products of the imbricated formation such that the wound package of individual printed products is capable of resisting disintegration during handling in an orientation in which said longitudinal axis of said at least one wound package of individual printed products extends substantially vertically;

removing said at least one wound package of individual printed products conjointly with said hollow substantially cylindrical winding core; and placing said at least one wound package of individual printed products into an orientation in which said longitudinal axis of said at least one wound package of individual printed products extends substantially vertically for performing a selected one of the steps of transporting, intermediately storing or both transporting and intermediately storing said at least one wound package of individual printed products.

2. The method as defined in claim 1, wherein:

the printed products have lower side edges when said longitudinal axis of said at least one wound product package extends substantially vertically; and during said step of placing said at least one wound product package into an orientation in which said longitudinal axis of said at least one wound product package extends substantially vertically handling the wound printed products while unsupported at said lower side edges.

3. The method as defined in claim 1, wherein:

said wound package of individual printed products has an outer periphery; and during said step of placing said at least one wound package of individual printed products into an orientation in which said longitudinal axis of said at least one wound package of individual printed products extends substantially vertically, grippingly engaging said at least one wound package of individual printed products at its periphery.

4. The method as defined in claim 1, wherein:

during said step of placing said at least one wound package of individual printed products into an orientation in which said longitudinal axis of said at least one wound package of individual printed products extends substantially vertically, engaging said at least one wound package of individual printed products at said at least one winding core upon which said at least one wound package of individual printed products is wound.

5. The method as defined in claim 1, wherein:

said wound package of individual printed products has an outer periphery; and during said step of placing said at least one wound package of individual printed products into an orientation in which said longitudinal axis of said at least one wound package of individual printed products extends substantially vertically, engaging said at least one wound package of individual printed products selectively at least at any one of its outer periphery and at said at least one winding core.

6. The method as defined in claim 1, wherein:

said step of intermediately storing said at least one wound package of individual printed products includes depositing a plurality of said wound packages of individual printed products in direct mutual contacting and superimposed relationship.

7. The method as defined in claim 1, wherein:

said step of placing said at least one wound package of individual printed products into an orientation in which said longitudinal axis of said at least one wound product package of individual printed products extends substantially vertically, further includes the step of placing said at least one wound package of printed individual products upon a pallet.

8. The method as defined in claim 7, wherein:

said pallet has a predeterminate width; and said step of forming said at least one wound package of individual printed products entails forming said at least one wound package of individual printed products such that an outer diameter of said at least one wound package of individual printed products is smaller than the width of said pallet.

9. The method as defined in claim 7, wherein:

said pallet has a predeterminate length; and said step of forming said at least one wound package of individual printed products entails forming said at least one wound package of individual printed products such that an outer diameter of said at least one wound package of individual printed products is smaller than the length of said pallet.

10. The method as defined in claim 7, wherein:

said pallet has a predeterminate width; and said step of forming said at least one wound package of individual printed products entails forming said at least one wound package of individual printed products such that an outer diameter of said at least one wound package of individual printed products is only slightly larger than the width of said pallet.

11. The method as defined in claim 7, wherein:

said pallet has a predeterminate length; and said step of forming said at least one wound package of individual printed products entails forming said at least one wound package of individual printed products such that an outer diameter of said at least one wound package of individual printed products is only slightly larger than the length of said pallet.

12. The method a described in claim 1, wherein:

said step of forming said at least one wound package of individual printed products further includes the step of constricting said at least one wound package of individual printed products at the region of said at least one winding strap.

13. The method as described in claim 1, wherein:

said step of delivering the imbricated formation to said at least one hollow substantially cylindrical winding core entails conveying said imbricated formation first to a predetermined one of at least two substantially superimposed winding locations for forming said at least one wound package of individual printed products at said predetermined one of said at least two substantially superimposed winding locations and thereafter conveying said imbricated formation to an other one of said at least two substantially superimposed winding locations for forming a further one of said at least one wound package of individual printed products at said other one of said at least two substantially superimposed winding locations.

14. The method as defined in claim 1, further including the steps of:

rotatably mounting said at least one wound package of individual printed products in an orientation where said longitudinal axis of said hollow substantially cylindrical winding core is disposed substantially horizontally in order to unwind the wound individual printed products from said at least one wound package of individual printed products; and unwinding said at least one wound package of individual printed products by rotating said at least one wound package of individual printed products about said substantially horizontally disposed longitudinal axis of said hollow substantially cylindrical winding core.

15. A method of processing individual printed products, such as newspapers, magazines, periodicals and the like arriving in an imbricated formation and having a predetermined number of substantially flat sides, comprising the steps of:

delivering the imbricated formation at a winding station to at least one winding core having a longitudinal axis disposed in a predeterminate orientation other than the vertical;

forming from said imbricated formation of individual printed products at least one wound package having a longitudinal axis by rotating said at least one winding core about said longitudinal axis of said winding core and winding up the imbricated formation of said individual printed products on said at least one winding core with a preselected one of said predetermined number of substantially flat sides of the imbricated formation facing said at least one winding core conjointly with at least one tensioned winding strap;

winding upon said winding core a predeterminate number of the individual printed products of the imbricated formation and thereby forming as said wound package a wound package containing said predeterminate number of individual printed products and resisting disintegration during handling in an orientation in which said longitudinal axis of said at least one wound package containing said predeterminate number of individual printed products extends substantially vertically;

removing said at least one wound package containing said predeterminate number of individual printed products conjointly with the associated winding core from said winding station;

placing said at least one wound package containing said predeterminate number of individual printed products into an orientation in which said longitudinal axis of said at least one wound package which contains said predeterminate number of individual printed products extends substantially vertically;

at a selected point in time rotatably mounting said at least one wound package containing said predeterminate number of individual printed products in a disposition where said longitudinal axis of said winding core extends in a direction other than the vertical in order to unwind the wound individual printed products from said at least one wound package containing said predeterminate number of individual products; and unwinding said at least one wound package containing said predeterminate number of individual printed products by rotating said at least one wound package containing said predeterminate number of individual printed products about said longitudinal axis of said winding core.

16. A method for processing individual printed products, such as newspapers, magazines, periodicals and the like arriving in an imbricated formation and having a predetermined number of substantially flat sides, comprising the steps of:

delivering the imbricated formation at a winding station to at least one winding core having a substantially horizontally disposed longitudinal axis;

forming at least one wound package of individual printed products having a longitudinal axis by rotating said at least one winding core about said substantially horizontally disposed longitudinal axis of said winding core and winding up the imbricated formation of individual printed products on said at least one winding core with a preselected one of said predetermined number of substantially flat sides of the imbricated formation facing said at least one winding core and in conjunction with at least one winding strap;

removing said at least one wound package of individual printed products conjointly with the associated at least one winding core from said winding station; and said step of forming said at least one wound package entailing winding up said at least one wound package of individual printed products to a predeterminate size capable of resisting disintegration during handling in an orientation in which said longitudinal axis of said at least one wound package of individual products extends substantially vertically.

17. The method as defined in claim 16, further including the step of:

placing said at least one wound package of individual printed products into said orientation in which said longitudinal axis of said at least one wound package of individual printed products extends substantially vertically for further handling said at least one wound package of individual printed products.

18. The method as defined in claim 17, wherein:

said step of placing said at least one wound package of individual printed products into said orientation for further handling entails transporting said at least one wound package of individual printed products while said longitudinal axis of said at least one wound package of individual printed products extends substantially vertically.

19. The method as defined in claim 17, wherein:

said step of placing said at least one wound package of individual printed products into said orientation for further handling entails intermediately storing said at least one wound package of individual printed products while said longitudinal axis of said at least one wound package of individual printed products extends substantially vertically.

20. An apparatus for processing individual printed products, such as newspapers, magazines, periodicals and the like having a predetermined number of substantially flat sides and arriving in an imbricated formation, comprising:

a winding station for winding up the individual printed products into at least one wound package having a longitudinal axis;

at least one hollow drivable substantially cylindrical winding core having a substantially horizontally disposed longitudinal axis and rotatably mounted about said substantially horizontally disposed longitudinal axis at said winding station;

conveying means for conveying the imbricated formation of individual printed products with a preselected one of said predetermined number of substantially flat sides of the individual printed products facing said at least one hollow substantially cylindrical winding core;

at least one winding strap connected to said at least one hollow substantially cylindrical winding core and windable under a predeterminate tension conjointly with the imbricated formation of individual printed products onto said at least one hollow substantially cylindrical winding core for forming said at least one wound package of individual printed products; and means for placing said at least one wound package of individual printed products into an orientation in which said longitudinal axis of said at least one wound package of individual printed products extends substantially vertically.

21. The apparatus as defined in claim 20, wherein:

said means for placing said at least one wound package of individual printed products into an orientation in which said longitudinal axis of said at least one wound package of individual printed products extends substantially vertically, comprising at least one device for engaging said at least one wound package.

22. The apparatus as defined in claim 21, wherein:

said at least one wound package of individual printed products has a periphery; and said at least one device of the means which place the longitudinal axis of said wound package of individual printed products into a substantially vertical orientation, and for engaging said at least one wound package of individual printed products, solely grippingly engages said at least one wound package of individual printed products at said periphery.

23. The apparatus as defined in claim 21, wherein:

said at least one device of the means which place the longitudinal axis of said wound package of individual printed products into a substantially vertical orientation, and for engaging said at least one wound package of individual printed products, solely grippingly engages said at least one wound package of individual printed products at said at least one hollow drivable substantially cylindrical winding core.

24. The apparatus as defined in claim 21, wherein:

said at least one wound package of individual printed has a periphery; and said at least one device of the means which place the longitudinal axis of said wound package of individual printed products into a substantially vertical orientation, and for engaging said at least one wound package of individual printed products, solely engages said at least one wound package of individual printed products selectively at least at one of said periphery and at said at least one hollow drivable substantially cylindrical winding core.

25. The apparatus as defined in claim 21, wherein:

said at least one device of the means which place the longitudinal axis of said wound package of individual printed products into a substantially vertical orientation, and for engaging said at least one wound package of individual printed products constitutes a mobile package engaging device.

26. The apparatus as defined in claim 21, wherein:

said at least one device of the means which place the longitudinal axis of said wound package of individual printed products into a substantially vertical orientation, and for engaging said at least one wound package of individual printed products is capable of stacking a plurality of the wound packages of individual printed products such that said longitudinal axis of each said wound package of individual printed products extends substantially vertically.

27. The apparatus as defined in claim 20, further including:

a pallet upon which there can be stacked a plurality of the wound packages of individual printed products; and means for transporting at least one of said wound packages of individual printed products in said substantially vertical orientation of its longitudinal axis to said pallet for stacking said wound packages of individual printed products thereupon.

28. The apparatus as defined in claim 27, wherein:

said means for transporting said at least one wound package of individual printed products in said substantially vertical orientation of its longitudinal axis to said pallet for stacking thereupon, comprises a forklift truck.

29. The apparatus as defined in claim 27, wherein;

said means for transporting said at least one wound package of individual printed products in said substantially vertical orientation of its longitudinal axis to said pallet for stacking thereupon, comprises a lift truck.

30. The apparatus a defined in claim 20, wherein:

said winding station comprises two substantially superimposed winding positions;

means for alternately and selectively feeding each said two substantially superimposed winding positions with the imbricated formation of individual printed products to be wound up;

each said winding position of said two substantially superimposed winding positions comprising means for rotatably mounting said at least one hollow drivable substantially cylindrical winding core;

at least one supply reel for delivering said at least one winding strap; and at least one further means for rotatably mounting said at least one supply reel.

31. The apparatus as defined in claim 20, further including:

an unwinding station for unwinding said at least one wound of individual printed products;

said unwinding station comprising at least one unwinding location; and said at least one unwinding location comprising means for rotatably mounting said at least one hollow drivable substantially cylindrical winding core such that said longitudinal axis thereof extends substantially horizontally and at least one further means for rotatably mounting at least one drivable reel for taking-up said at least one winding strap.

32. The apparatus as defined in claim 31, wherein:

said at least one unwinding location comprises two of said unwinding locations arranged in substantially superimposed relationship.

33. An apparatus for processing individual printed products, such as newspapers, magazines, periodicals and the like having a predetermined number of substantially flat sides and arriving in an imbricated formation, comprising:

a winding station for winding up the individual printed products into at least one wound package of individual printed products having a longitudinal axis;

at least one hollow drivable substantially cylindrical winding core having a substantially horizontally disposed longitudinal axis and rotatably mounted about said substantially horizontally disposed longitudinal axis at said winding station;

conveying means for conveying the imbricated formation of the individual printed products with a preselected one of said predetermined number of substantially flat sides of the individual printed products facing said at least one hollow substantially cylindrical winding core;

at least one winding strap connected to said at least one hollow drivable substantially cylindrical winding core and windable under a predeterminate tension conjointly with the imbricated formation of individual printed products onto said at least one hollow substantially cylindrical winding core for forming said at least one wound package of individual printed products;

said winding station winding up a wound package containing a predeterminate number of individual printed products resisting disintegration in an orientation in which said longitudinal axis of said wound package of individual products extends substantially vertically;

means for placing said at least one wound package of individual printed products into an orientation in which said longitudinal axis of said at least one wound package of individual printed products extends substantially vertically;

an unwinding station for unwinding said at least one wound package of individual printed products;

said unwinding station comprising at least one unwinding location; and said at least one unwinding location comprising means for rotatably mounting said at least one hollow drivable substantially cylindrical winding core such that said longitudinal axis thereof extends substantially horizontally and at least one further means for rotatably mounting at least one drivable reel for taking-up said at least one winding strap.

34. A wound package containing individual printed products and having a longitudinal axis, comprising:

a hollow substantially cylindrical winding core upon which there are wound individual printed products of said wound package of individual printed products;

a winding strap;

a plurality of said individual printed products being wound in layers upon said hollow substantially cylindrical winding core conjointly with said winding strap which is under a predeterminate tension and such that said winding strap is located between said layers; and the wound package of individual printed products having a predeterminate size and an inherent stability permitting handling of the wound package of individual printed products for performing a desired one of the operations of transporting, intermediately storing or a combination of transporting and intermediately storing the wound package of individual printed products while said longitudinal axis of the wound package of individual printed products extends substantially vertically without there occurring disintegration of the wound package of individual printed products.

35. The wound package of individual printed products as defined in claim 34, wherein:

said plurality of individual printed products have side edges; and said side edges of said plurality of individual printed products constituting exposed side edges.

36. The wound package of individual printed products as defined in claim 34, wherein:

said plurality of individual printed products have a predeterminate width; and said hollow substantially cylindrical winding core having a predeterminate length which does not exceed said predeterminate width of said plurality of individual printed products.

37. The wound package of individual printed products as defined in claim 34, wherein:

the wound package of individual printed products comprises a region of compression caused by said winding strap.

38. The wound package of individual printed products as defined in claim 34, wherein:

said hollow substantially cylindrical winding core has an inner side; and said inner side of said hollow substantially cylindrical winding core forming a substantially cylindrical jacket surface over its entire length.

39. The wound package of individual products as defined in claim 34, wherein:

said hollow substantially cylindrical winding core has an inner side; and said inner side of said hollow substantially cylindrical winding core being provided with circumferential rib means.

40. A method of processing individual printed products, such as newspapers, magazines, periodicals and the like arriving in an imbricated formation and having a predetermined number of substantially flat sides and side edges, comprising the steps of:

delivering the imbricated formation to at least one hollow substantially cylindrical winding core having a substantially horizontally disposed longitudinal axis;

forming from said imbricated formation of individual printed products at least one wound package containing said individual printed products and having a longitudinal axis and two opposite sides associated with the respective side edges of said individual printed products by rotating said at least one hollow substantially cylindrical winding core about said substantially horizontally disposed longitudinal axis of said winding core and winding up the imbricated formation on said at least one hollow substantially cylindrical winding core with a preselected one of said predetermined number of substantially flat sides of the imbricated formation of the individual printed products facing said at least one hollow substantially cylindrical winding core conjointly with at least one winding strap while maintaining said at least one winding strap under tension;

said at least one wound package of individual printed products being wound with a predeterminate number of the individual printed products of the imbricated formation such that the wound package of individual printed products is capable of resisting disintegration during handling in an orientation in which said longitudinal axis of said at least one wound package of individual printed products extends substantially vertically;

removing said at least one wound package of individual printed products conjointly with said hollow substantially cylindrical winding core; and placing said at least one wound package of individual printed products in an unsupported state of at least a lower one of said two sides associated with said respective side edges of said individual products, into an orientation in which said longitudinal axis of said at least one wound package of individual printed products extends substantially vertically for performing a selected one of the steps of transporting, intermediately storing or both transporting and intermediately storing said at least one wound package of individual printed products.

41. An apparatus for processing individual printed products, such as newspapers, magazines, periodicals and the like having a predetermined number of substantially flat sides and side edges and arriving in an imbricated formation, comprising:

a winding station for winding up the individual printed products into at least one wound package containing said individual printed products and having a longitudinal axis and two sides associated with the side edges of the individual printed products;

at least one hollow drivable substantially cylindrical winding core having a substantially horizontally disposed longitudinal axis and rotatably mounted about said substantially horizontally disposed longitudinal axis at said winding station;

conveying means for conveying the imbricated formation of individual printed products with a preselected one of said predetermined number of substantially flat sides of the individual printed products facing said at least one hollow substantially cylindrical winding core;

at least one winding strap connected to said at least one hollow substantially cylindrical winding core and windable under a predeterminate tension conjointly with the imbricated formation of individual printed products onto said at least one hollow substantially cylindrical winding core for forming said at least one wound package of individual printed products; and means for placing said at least one wound package of individual printed products, in an unsupported state of at least a lower one of said two sides associated with said side edges of said individual printed products, into an orientation in which said longitudinal axis of said at least one wound package of individual printed products extends substantially vertically.

* * * * *

UNITED STATES PATENT AND TRADEMARK OFFICE

CERTIFICATE OF CORRECTION

PATENT NO. : 4,769,973

DATED : SEPTEMBER 13, 1988

INVENTOR(S) : WALTER REIST

It is certified that error appears in the above-identified patent and that said Letters Patent is hereby corrected as shown below:

Column 16, line 37, after "printed" please insert --products--

Column 17, line 39, after "wound" please insert --package--

Signed and Sealed this

Seventh Day of March, 1989

*Attest:*

DONALD J. QUIGG

*Attesting Officer*

*Commissioner of Patents and Trademarks*